United States Patent [19]

Subramanyam et al.

[11] 4,425,169

[45] Jan. 10, 1984

[54] AUSTENITIC-MANGANESE STEEL

[75] Inventors: Dilip K. Subramanyam, Pompton Lakes; Henry J. Chapin; Bruce A. Heyer, both of Mahwah, all of N.J.

[73] Assignee: Abex Corporation, New York, N.Y.

[21] Appl. No.: 372,198

[22] Filed: Apr. 26, 1982

[51] Int. Cl.[3] ..... C22C 38/04

[52] U.S. Cl. ..... 148/137; 75/124; 75/126 A; 75/126 B

[58] Field of Search ..... 148/134, 137, 3, 31, 148/37, 38; 75/124 F, 126 A, 126 B

[56] References Cited

U.S. PATENT DOCUMENTS

| | | | |
|---|---|---|---|
| 1,975,746 | 10/1934 | Hall | 148/137 |
| 2,965,478 | 12/1960 | Armitage | 148/137 |
| 3,201,230 | 8/1965 | Mitchell et al. | 148/137 |

FOREIGN PATENT DOCUMENTS

| | | | |
|---|---|---|---|
| 648647 | 2/1979 | U.S.S.R. | 75/124 F |

*Primary Examiner*—L. Dewayne Rutledge
*Assistant Examiner*—Debbie Yee
*Attorney, Agent, or Firm*—Kinzer, Plyer, Dorn & McEachran

[57] ABSTRACT

Fine grained austenite achieved in (12%) manganese steel, without annealing, by a novel combination of carbon and aluminum.

1 Claim, 5 Drawing Figures

AUSTENITIC-MANGANESE STEEL

This invention relates to manganese steel and in particular to an austenitic manganese steel alloy having a pearlitic microstructure in the as-cast form, not requireing heat treatment to achieve that structure.

The importance of fine grain size in austenitic manganese steel is stressed in U.S. Pat No. 1,975,746; fine grain size is achieved by annealing the casting to obtain pearlite, and afterwards, by the standard "toughening" heat treatment, it is reaustenitized. The annealing treatment is usually (or typically) around 1000° F. for twenty-four hours or more. It is our experience that the result is usually only a partially complete transformation in the standard alloy. This successive heat treatment procedure has been a method for obtaining fine-grained austenitic manganese steel in addition to the regular practice of employing low melt superheats during casting. In heavier castings, the use of very low superheats is not very practical due to the increased likelihood of shrinkage-type defects. One of the objects of the present invention is to produce a manganese steel of fine grain character in a more economical manner than heretofore. Specifically an object of the invention is to achieve manganese steel of fine grain microstructure by producing a pearlitic structure in the as-cast state, which transforms during the standard ("toughening") heat treatment to yield the desired fine grained manganese steel. Thus, under the present invention an intermediate heat treatment is not necessary; nor is it necessary to use a low (melt) pouring temperature to encourage pearlite formation.

Stated in different words, it is an object of the present invention to obtain a pearlitic structure in the as-cast state so that with the present alloy it becomes quite unnecessary to adopt the annealing heat-treatment mentioned in Hall U.S. Pat. No. 1,975,746 in order to obtain pearlite which subsequently is transformed to a fine grain structure.

In accordance with the present invention the objects are achieved by a unique combination of manganese, carbon and aluminum values which when combined account for exceptionally high levels of pearlitic structure in the as-cast condition under relatively slow rates of cooling, transforming to fine grained austenite when heat-treated by the standard austenitizing heat treatment, which is time and temperature dependent upon the section size and exact chemistry. After the transformation heat treatment practically none of the original large grain size pearlite structure remains—just fine grain austenite which is the desired structure.

DESCRIPTION OF THE PREFERRED EMBODIMENTS

Figure 1:
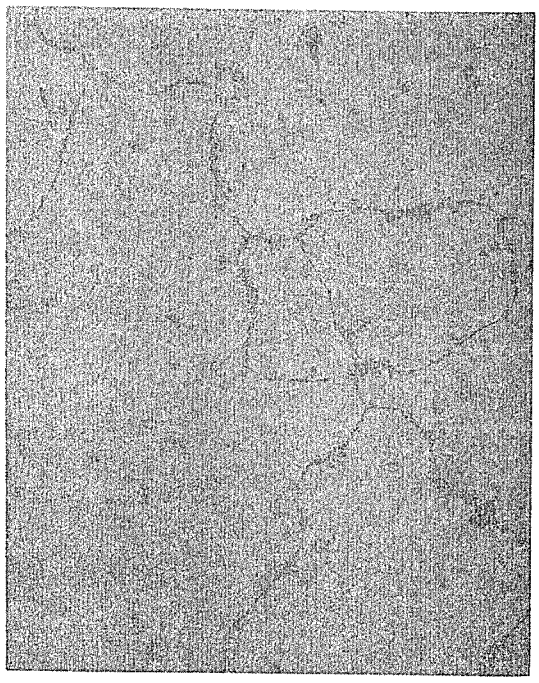
FIG. 1 is a photomicrograph (100X) of manganese steel (12% manganese, 1.15% carbon) in the as-cast condition.
Figure 2:
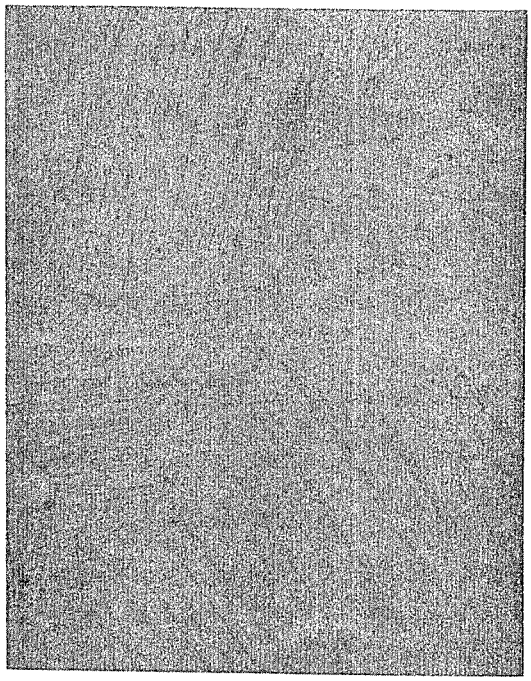
FIG. 2 is a photomicrograph (100X) of the aforesaid as-cast alloy following the standard heat treatment ("toughening") for austenitization.

Referring to the photomicrographs, FIG. 1 shows a typical (standard) manganese steel alloy in the as-cast state with typical large austenite grains having carbides at and defining the grain boundaries. FIG. 2 shows the casting of FIG. 1 following heat treatment ("toughening") in which all the carbide has gone into solution in the austenite; there is essentially no change in grain size. This heat treatment dissolves all the carbides and is reponsible for producing a tough alloy which is inherently work-hardenable. One method for obtaining a finer grain size, apart from the use of low pouring temperatures during the casting process, is to impose an intermediate heat treatment to obtain a pearlitic structure as described in the above-mentioned Hall patent.

Figure 3:
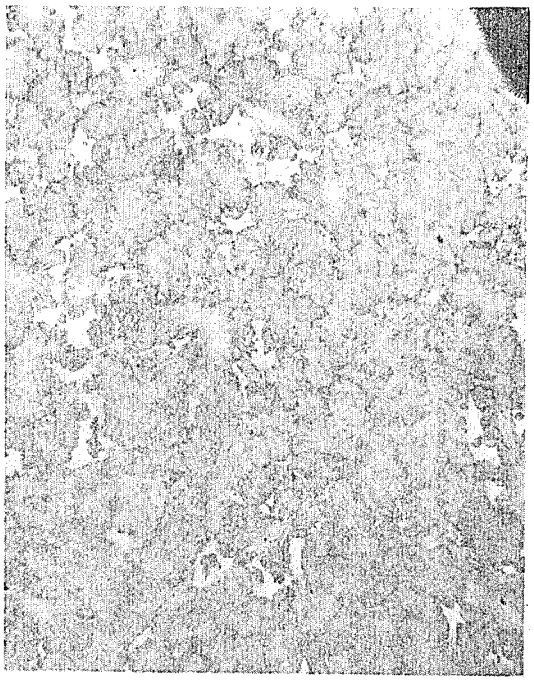
FIG. 3 is a photomicrograph (100X) of manganese steel (11% manganese, 1.75% carbon, 2.5% aluminum) in the as-cast state etched to reveal the pearlite structure achieved in accordance with the present invention.
Figure 4:
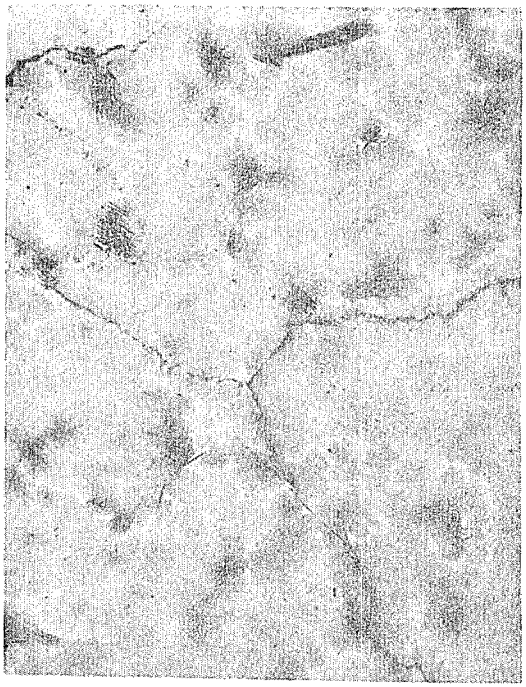
FIG. 4 is a photomicrograph (100X) of the same alloy shown in FIG. 3 but etched differently to show the as-cast grain size.
Figure 5:
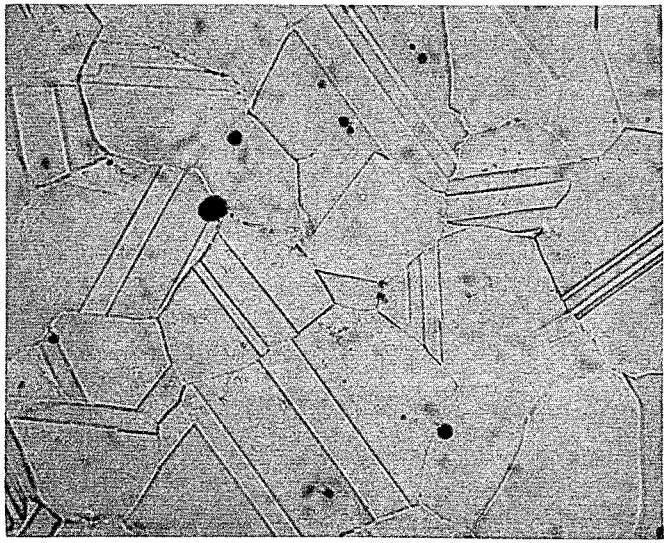
FIG. 5 is a photomicrograph (100X) of the alloy shown in FIGS. 3 and 4 following the standard "toughening" heat treatment.

FIGS. 3 and 4 for comparison show the as-cast condition for the present alloy. FIG. 3 shows the degree of pearlitization obtained in the as-cast state and FIG. 4 shows the very large as-cast grain size. FIG. 5 shows the microstructure of the present alloy after heat treatment. The microstructure of FIGS. 3 and 4 is essentially pearlite of large grain size which transforms to fine grained austenite upon subsequent heat treatment when the casting is heat treated at say 2050° F. for 2 to 4 hours before being quenched in agitated water.

Practice according to the present invention depends upon incorporating aluminum in the heat in an amount that requires mixing and pouring under nonoxidizing conditions using any preferred technique.

The examples to be set forth represnt the preferred modes and from these we envision the invention may be practiced within the following range:

C—1.5/2.0
Mn—10/13
Si—0/0.8
Cr—0.5/2
Al—1/3 balance all iron except for impurities and tramp elements such as phosphorus, sulfur, molybdenum and/or nickel found in the scrap iron used in the melt.

| | EXAMPLES | | | | | |
|---|---|---|---|---|---|---|
| | C | Mn | Si | Al | Cr | ASTM Grain Size |
| 1 | 1.76 | 10.46 | 0.55 | 2.50 | 0.70 | 1–1½* |
| 2 | 1.46 | 11.13 | 0.46 | 1.19 | 0.71 | 1* |
| 3 | 1.5 | 10.67 | 0.55 | 2.50 | 2.09 | 1–2* |
| 4 | 1.94 | 12.68 | 0.24 | 2.26 | — | 2** |

(The limited amounts of chromium augment yield strength and do not influence the grain size principles of this invention.)
*After transformation at 2050° F. - 3 hours - W.Q.
**After transformation at 2050° F. - 4 hours - W.Q.

Higher pouring temperatures may be used and this helps to assure sound castings free of shrinkage porosity which has been one of the troublesome features under prior practices where pearlite in predominant amounts is sought to be achieved with low (melt) pouring temperatures. In this same connection we prefer to see that the castings are allowed to cool slowly before shaking them out (removing them) from the sand mold (say below 600° F.) since pearlite formation is encouraged by slow cooling, as is known.

There are, of course, infinite variations for the combination of carbon, aluminum and high manganese for producing the desired pearlite in the as-cast structure. The exact limits within which equivalent results are obtained would require endless work. By "high manganese" we mean an amount of manganese sufficient to stabilize the austenite microstructure and, again, there is probably some latitude permissible in the preferred 10–13 range given above.

We claim:

1. A fine grained austenitic manganese steel casting having an ASTM grain size up to about 2 produced from one of the following alloys:

(a) an alloy consisting essentially of in weight percents
C 1.76
Mn 10.46
Al 2.50
Cr up to 2
Si up to 0.8
balance essentially iron and impurities;

(b) an alloy consisting essentially of weight percents
C 1.46
Mn 11.13
Al 1.19
Cr up to 2
Si up to 0.8
balance essentially iron and impurities;

(c) an alloy consisting essentially of in weight percents
C 1.50
Mn 10.67
Al 2.50
Cr up to 2
Si up to 0.8
balance essentially iron and impurities; or (d) an alloy consisting essentially of in weight percents
C 1.94
Mn 12.68
Al 2.26
Cr up to 2
Si up to 0.8
balance essentially iron and impurities which when slowly cooled after casting exhibits a predominantly pearlitic microstructure without having to anneal the as-cast casting to obtain pearlite and in which the pearlite recrystallizes upon solutionizing (austenitizing) to form the fine grained austenite without any intervening annealing.

* * * * *